US005338185A

United States Patent [19]

Henderson et al.

[11] Patent Number: 5,338,185

[45] Date of Patent: Aug. 16, 1994

[54] SAFETY DEVICE FOR PREVENTING UNCONTROLLED FLAREUP IN WICK-FED LIQUID FUEL BURNERS

[75] Inventors: Richard W. Henderson, Quinby, S.C.; George R. Lightsey, Starkville, Miss.

[73] Assignee: Southeastern Research Laboratories, Inc., Quinby, S.C.

[21] Appl. No.: 130,920

[22] Filed: Oct. 4, 1993

[51] Int. Cl.[5] ..... F23H 5/00

[52] U.S. Cl. ..... 431/33; 431/34

[58] Field of Search ..... 431/33, 34

[56] References Cited

U.S. PATENT DOCUMENTS

| | | | |
|---|---|---|---|
| Re. 16,339 | 5/1926 | Daniels . | |
| 3,169,519 | 2/1965 | Aizawa . | |
| 3,501,252 | 3/1970 | Richardson . | |
| 4,363,620 | 12/1982 | Nakamura . | |
| 4,664,095 | 5/1987 | Takahashi . | |
| 4,797,088 | 1/1989 | Nakamura et al. | 431/33 |
| 4,872,831 | 10/1989 | Fujimoto . | |
| 5,080,578 | 1/1992 | Josephs . | |
| 5,165,883 | 11/1992 | Van Bemmel . | |

FOREIGN PATENT DOCUMENTS 1205018 9/1970 United Kingdom .

OTHER PUBLICATIONS

Richard W. Henderson and George R. Lightsey, "Kerosene Heater Fires: Barometric Type," *Fire Marshals Bulletin* (87-5), pp. 8-10, Nov. 1987.

Richard W. Henderson and George R. Lightsey, "Kerosene Heater Fires: Barometric Type," *The National Fire and Arson Report*, vol. 6(1), pp. 2-4 (1988).

Richard W. Henderson, "Barometric Kerosene Heaters," *Fire and Arson Investigator*, vol. 39(3), pp. 26-27 (Mar. 1989).

John J. Lentini, "Gasoline and Kerosene Don't Mix-At Least, Not in Kerosene Heaters", *Fire Journal*, vol. 83(4), pp. 13, 86 (Jul.-Aug.) (1989).

*Primary Examiner*—Carroll B. Dority

*Attorney, Agent, or Firm*—David Pressman

[57] ABSTRACT

A safety device for preventing uncontrolled burning in wick-fed liquid fuel burners employs an excess fuel containment compartment (24) which receives any excess fuel which might be fed to the fuel supply chamber (40) . The excess fuel causes a receptacle (20) in the compartment to move downwardly. Through a rod (30) and balance arm (18), such movement communicates with an automatic wick extinguisher (42) to extinguish the wick flame immediately in response to the excess fuel condition. Also the mechanism prevents re-ignition of the wick (54) until the danger of flareup is removed. This safety device also alerts the user of the liquid fuel burner to dangerous conditions by a mechanism comprising a highly visible warning gauge needle (34) . In addition, this safety device can be easily reset if accidentally triggered when overflow conditions do not exist, and the burner can be readily serviced and restored to operation should an excess fuel malfunction occur.

20 Claims, 2 Drawing Sheets

SAFETY DEVICE FOR PREVENTING UNCONTROLLED FLAREUP IN WICK-FED LIQUID FUEL BURNERS

BACKGROUND OF THE INVENTION

1. Field of Invention

This invention relates to safety devices, specifically to a flareup prevention mechanism for wick-fed liquid fuel burners.

2. Discussion of Prior Art

In wick-fed, liquid fuel burners, such as kerosene heaters, liquid fuel from a fuel chamber is supplied to a wick which is exposed to the oxygen of the atmosphere. Once the wick has been ignited, flame intensity and heat generation are controlled by positioning the wick with respect to a wick receiving chamber.

A common type of kerosene heater is the barometric style, in which fuel is delivered to a horizontal fuel chamber from a vertically-oriented removable tank inserted into the fuel chamber. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve in the removable tank cap, which allows air to enter the removable tank. As air enters the removable tank through the barometric valve, fuel in the removable tank flows into the fuel chamber until the fuel level in the fuel chamber rises and covers the barometric valve in the removable tank cap, at which point fuel flow from the removable tank will cease.

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. The primary problem with such burners is that, under certain conditions, fuel can overflow the fuel chamber. When the flooded fuel ignites, the result is an uncontrolled fire, or flareup.

The most common reason for fuel overflow is the accidental use of fuels with high vapor pressures. Examples of such fuels are gasoline, naphtha, and inferior kerosene, which has a low flash point. In a barometric heater, there is a partial vacuum in the removable tank, and overflow of fuel from the fuel chamber can occur if this vacuum is lost. As the temperature of the heater and its surroundings increases, the vapor pressure of the fuel in the removable tank increases and, under certain conditions, allows fuel to escape from the removable tank at a rate greater than the rate of burning of the fuel. The excess fuel eventually overflows the fuel chamber and spills onto the top of the fuel chamber and the surface supporting the heater. The spilled fuel can then ignite, causing an uncontrolled fire. A second way that the partial vacuum in the barometric heater's removable tank can be lost is by air entering through compromise of the integrity of the removable tank.

Although fuel overflow is a widely recognized phenomenon, I am not aware of any mechanism or method which has been employed to prevent its occurrence or to prevent flareup once overflow occurs.

There are safety devices that drop the wick down, thereby extinguishing the flame, if the burner tips over or experiences excessive vibration. Other safety devices detect high levels of $CO_2$ and low levels of $O_2$, and use these to control burning rates. Still others regulate the position of the wick during the ignition and extinguishing operations of the heater to prevent excessive flaming during these operations. Examples are shown in U.S. Pat. No. 4,363,620, issued Dec. 14, 1982 to Nakamura, U.S. Pat. No. 4,872,831, issued Oct. 10, 1989 to Fujimoto, and U.S. Pat. No. 5,165,883, issued Nov. 24, 1992 to Van Bemmel. In some cases, the safety devices require the use of electrical power and electronic circuitry for actuation.

It has been suggested in two publications ("Kerosene Heater Fires: Barometric Type," R. Henderson et al., *Fire Marshals Bulletin* (*National Fire Protection Association*), Vol. 87-5, p. 8 (1987); "Barometric Kerosene Heaters," R. Henderson, *Fire and Arson Investigator* (International Association of Arson Investigators), Vol. 39, No. 3, p. 26 (1989)) that the size of the removable tank of barometric kerosene heaters be made comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented.

Also, it has been suggested that a float device be introduced into the fuel chamber to be used to activate the automatic wick extinguishing mechanism, and a sight gauge be present to show dangerous fuel levels in the fuel chamber. Introduction of such a float device would al so require that the fuel chamber be redesigned, as discussed above. Although some burners have sight gauges in the fuel chamber, the sight gauges are used only to indicate whether or not fuel is present, and not when dangerous fuel levels are present in the fuel chamber.

U.S. Pat. No. 5,080,578, issued Jan. 14, 1992 to Josephs, claims that its device controls flareup in wick-fed liquid fuel burners by a) cutting off the flow of fuel to the wick in response to excessive heat by blocking a fuel line, and b) withdrawing the wick into the wick chamber when sensing excessive heat. However, this device has several disadvantages.

a) Excessive heat must be generated near the sensors before the flow of fuel is interrupted, or the wick is withdrawn. Therefore, since flareup is not prevented, the device only limits the spread of excessive flames after flareup has already occurred.

b) Excessive heat sensing devices must be near the area where uncontrolled burning is taking place due to overflow of fuel. Often the path that the overflowing fuel takes is random and flareup may not initially occur near the heat sensors.

c) The device is not applicable to barometric liquid fuel burners—the most common wick fed liquid fuel burners in use—because these burners do not have fuel lines.

d) From the onset of flareup in wick-fed liquid fuel burners, fire is present outside the wick, and therefore retracting the wick does not affect the flareup process.

OBJECTS AND ADVANTAGES

Accordingly, several objects and advantages of the present invention are to provide wick-fed, barometric liquid fuel burners with a safety device which prevents fuel overflow from the fuel chamber, and therefore, prevents flareup, does not require the reduction in capacity of the removable fuel tank, does not require an increase in the capacity of the fuel chamber, does not require the redesigning of the fuel chamber to accommodate a float device, does not require electrical power or electronic circuitry, does not require the presence of excessive heat for its actuation, and is applicable to kerosene heaters that do not have fuel lines.

In addition, the present invention will not add substantially to the weight of the burners, will provide a warning device to alert consumers of the dangerous condition in the liquid fuel burner, will prevent ignition of the wick as long as dangerous conditions are present in the burner, is easily serviced should excess fuel enter the fuel chamber, will save lives and property, will make barometric liquid fuel burners easter to market because of added safety value, and will likely reduce the number of expensive lawsuits prompted by injury, loss of life, and property damage. Still further objects and advantages will become apparent from a consideration of the ensuing description and drawings.

DRAWING REFERENCE NUMERALS

Figure 1:
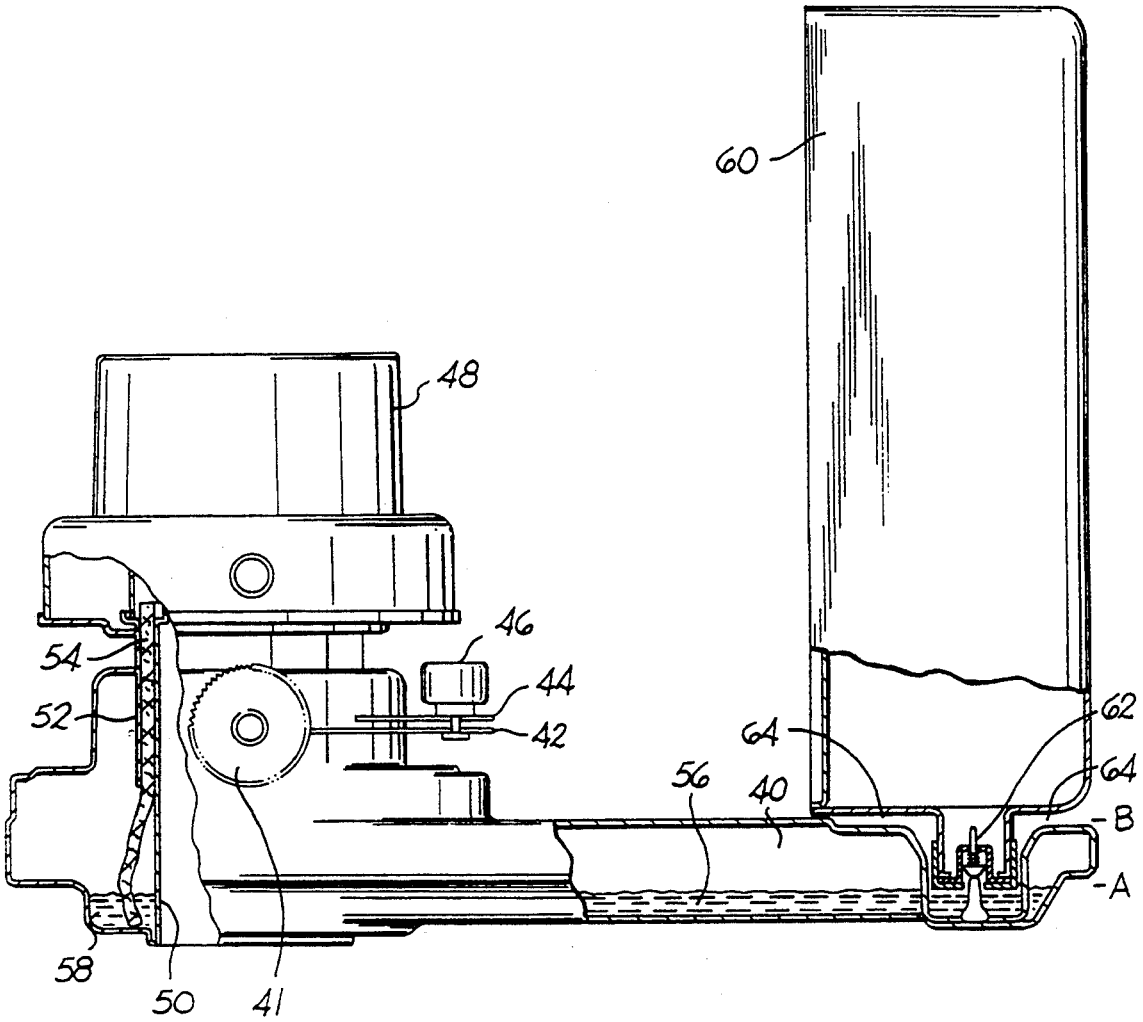
PRIOR ART FIG. 1
FIG. 1 is a side sectional view of a prior-art, conventional wick-fed, barometric liquid fuel burner with a vibration sensing weight that activates an automatic wick extinguishing unit.

10 Cap
12 Eductor tube
14 Float
16 Pivot point
18 Balance arm
20 Receptacle
22 Attached at
24 Excess fuel containment compartment
26 Port
28 Rod guide
30 Rod
32 Attached at
34 Warning gauge needle
36 Pivot point
38 Operating lever
40 Fuel chamber
41 Wick gear
42 Automatic wick extinguishing unit
44 Frame member
46 Vibration sensing weight
48 Combustion cylinder
50 Inner wick guide
52 Outer wick guide
54 Wick
56 Fuel
58 Wick fuel supply reservoir
60 Removable fuel tank
62 Barometric valve
64 Opening
A Normal fuel level
B Flooded fuel level

SUMMARY

In accordance with the present invention an anti-flareup safety device for wick-fed, barometric liquid fuel burners effectively detects the presence of excess fuel in the fuel chamber and extinguishes the burner flame to prevent flareup. The device deflects a warning gauge needle to warn of a dangerous condition, prevents re-ignition of the wick as long as the dangerous condition exists, actuates the safety device as long as a dangerous excess fuel condition is present, allows easy re-setting should the safety device be actuated accidentally, and enables the burner to be easily serviced should excess fuel actuate the safety device.

The safety device includes an excess fuel containment compartment to receive and hold excess fuel, a receptacle which is located inside the excess fuel containment compartment and which receives excess fuel from the fuel chamber, and which moves downward in response to the added weight of the excess fuel, a float which maintains the downward position of the receptacle should the receptacle overflow, a rod which is pulled downward by the movement of the receptacle, an operating lever which moves downward with the rod, a warning gauge needle which deflects in response to the movement of the operating lever, and an automatic wick extinguisher unit that is actuated when the operating lever is rotated by the downward pull of the rod.

DESCRIPTION—CONVENTIONAL HEATER STRUCTURE—FIG. 1

The advantages of the present safety device will be better understood by reference to the following detailed description of the accompanying drawings in which reference numerals designate corresponding parts.

FIG. 1 is a side sectional view of a conventional wick-fed, barometric liquid fuel burner that operates by burning a liquid fuel, such as kerosene. The burner is a wick-fed type with combustion cylinder 48 and is constructed in a manner widely known in the art.

In normal operation fuel is delivered from a removable fuel tank 60 to a horizontal fuel chamber 40. A barometric valve 62 in the cap of removable tank 60 maintains the fuel level at level A by allowing air to flow into removable tank 60 and fuel to flow from removable tank 60 into fuel chamber 40 when the fuel level drops below level A due to fuel consumption by wick 54. A partial vacuum above the fuel in removable tank 60 maintains the fuel in removable tank 60 above level A until all of the fuel has been discharged from tank 60. Fuel 56, which is in fluid communication with wick 54, migrates by capillary action up wick 54 and is burned inside combustion cylinder 48.

Wick 54 is cylindrical in shape and is shown in a partial cross-sectional view. Wick 54, wick guides 50 and 52, combustion cylinder 48, wick fuel supply reservoir 58, and vibration sensing weight 46 in FIG. 1 are circular in shape when seen from above, whereas compartment 40 is generally rectangular. Removable fuel tank 60 is most commonly rectangular in shape as viewed from above, but various other shapes are also found, such as triangular.

The fuel burner has automatic wick extinguishing unit 42, which includes a vibration sensing weight 46. If the liquid fuel burner is tilted or vibrated excessively, automatic wick extinguishing unit 42 disengages wick gear 41, which lowers wick 54, extinguishing the flame.

This burner, with its automatic wick extinguishing unit, is widely known in the art. Manufacturers include Toyotomi Kogyo Co., Ltd., and Hitachi Heating Appliances Co., Ltd., both of Japan.

OPERATION AND DANGER OF FLAREUP WITH CONVENTIONAL BURNER—FIG. 1

If the partial vacuum in tank 60 is lost due to introduction of high vapor pressure fuels, such as gasoline or inferior kerosene, or if the integrity of tank 60 is compromised, valve 62 no longer regulates fuel flow from tank 60. As a result excessive fuel will flow into chamber 40. Since the capacity of tank 60 is considerably greater than that of chamber 40 in wick-fed, liquid fuel burners commonly in use, chamber 40 is not able to contain all of the fuel from tank 60, if any significant amount of fuel is present in removable tank 60. As a result, fuel chamber 40 fills with fuel. Since tank 60 and chamber 40 are not mechanically connected, when chamber 40 has filled to level B, the excess fuel will flow out opening 64, and spread over the fuel chamber's surface and to other areas in the burner. The flooded fuel will ignite because the vapors from the leaked fuel are drawn by air movement toward the wick flame, which is of sufficient temperature to ignite these fumes. As a result there will be flames in and around tank 60, the location of the fuel leak, causing the pressure inside tank 60 to increase drastically, driving more fuel out of tank 60, further increasing the amount of escaped fuel, and accordingly increasing the severity of the flareup.

As stated, prior-art safety devices do not prevent flareup, but rather detect evidence that flareup has begun. Most of these devices will trigger an automatic wick extinguishing unit (not shown), which acts to extinguish the flame on the wick. However, by the time flareup has begun, there are flames outside the wick area and extinguishment of the wick flame does not affect the progression of flareup. The flames are present where fuel has flooded, and the increasing amounts of fuel being discharged from the removable tank further increase the magnitude of the flareup incident, as described earlier.

Thus, prior-art safety devices, such as those to monitor excessive vibration of the burner, to detect high levels of $CO_2$ and low levels of $O_2$, and to regulate the position of the wick to prevent excessive flaming, are ineffective in preventing flareup. The safety device described in the Josephs patent, supra, does not prevent flareup, but rather provides a wick drop mechanism, and cuts off fuel flow through a fuel line after the onset of flareup. Since the wick-fed barometric liquid fuel burners in common use do not utilize a fuel line , Josephs' device is not applicable to them.

DESCRIPTION OF INVENTIVE ANTI-FLAREUP DEVICE—FIG. 2

Figure 2:
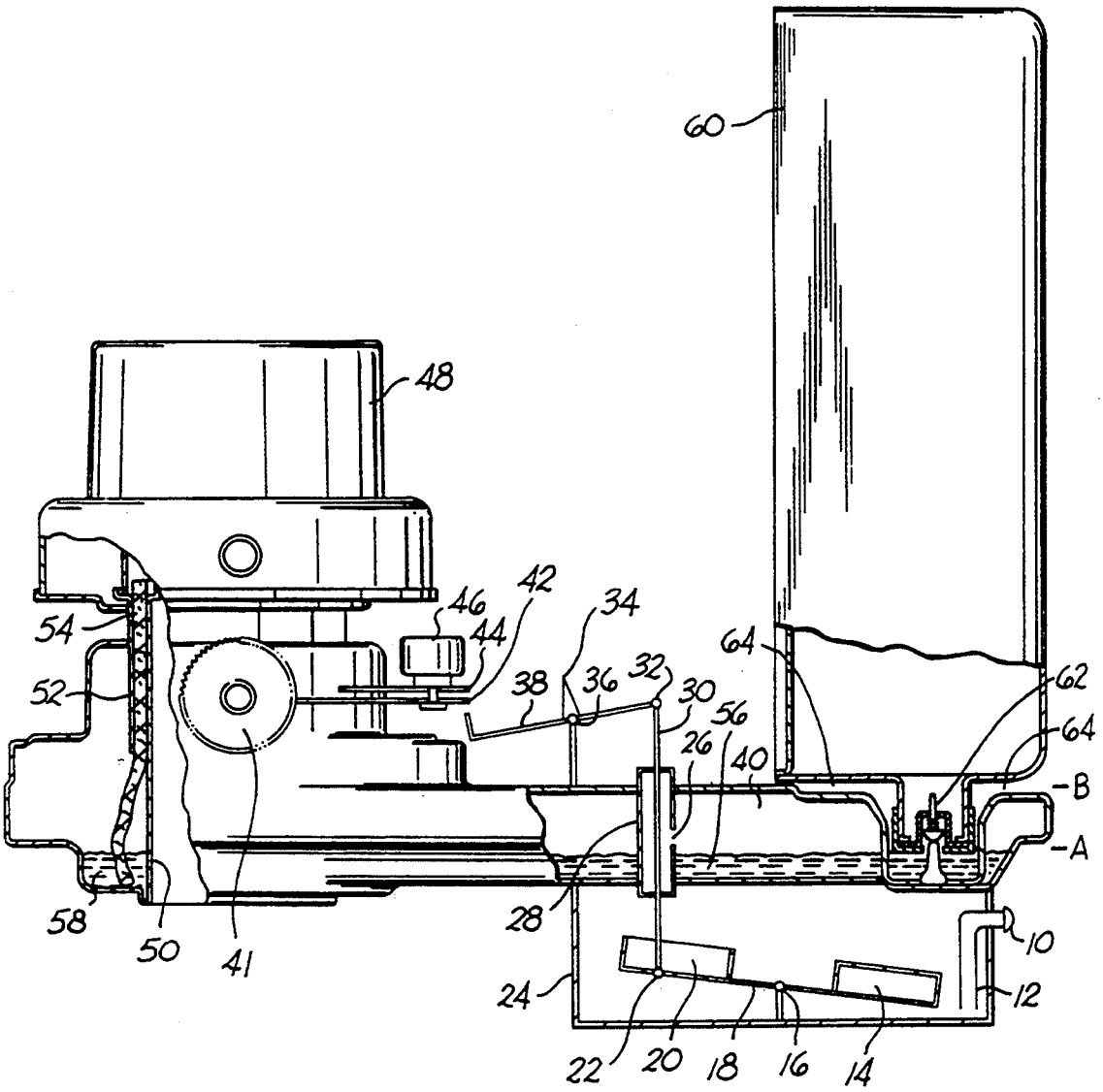
FIG. 2 is a side sectional view of a wick-fed, barometric liquid fuel burner showing the operating mechanism of the anti-flareup safety device in accordance with the preferred embodiment of the present invention.

FIG. 2 shows various parts of a wick-fed, barometric liquid fuel burner, including the following conventional elements: a removable tank 60, a barometric valve 62, a fuel chamber 40, a wick 54, a combustion cylinder 48, a vibration-sensing weight 46, and an automatic wick extinguishing unit 42.

In addition, the burner of FIG. 2 includes additional elements which constitute a preferred embodiment of the present inventive anti-flareup safety device. An excess fuel containment compartment 24 is located below fuel chamber 40. Inside compartment 24 is found an eductor tube 12 sealed by a cap 10. Also, in compartment 24, a float device 14 is attached to a balance arm 18, which moves about a pivot point 16, which is secured to a convenient frame member, such as the bottom of compartment 24.

A receptacle 20 is attached to balance arm 18 at the end opposite float device 14. At its lower end, a rod 30 is attached at attachment point 22 to receptacle 20. Rod 30 passes through chamber 40 inside a rod guide 28, which has a port 26 incorporated into the cylindrical rod guide wall inside chamber 40. At its uppermost end, rod 30 is attached at point 32 in a pivoting fashion to an operating lever 38, which is attached at a pivot point 36, which is secured to a convenient frame member, such as the top of chamber 40. A warning gauge needle 34 is situated on lever 38. The end of lever 38 distal from point 32 is situated in proximity to an automatic wick extinguishing unit 42, which it strikes and actuates when urged upward.

When viewed from above, compartment 24 preferably has the shape of chamber 40, which is rectangular, but may have other shapes. The dimensions of compartment 24 will be approximately six inches wide by seven inches long by two inches deep. Receptacle 20 is a container which has an opening at its topmost surface, and which is preferably square or rectangular, but may be of any shape that will fit conveniently and easily inside compartment 24, provided that its walls and bottom are Joined in a liquid-tight manner. Float 14 preferably is square or rectangular, but may be of any shape that will conveniently and easily fit inside compartment 24. Receptacle 20 and float 14 are each of approximate dimensions two and one-half inches wide by three inches long by one inch deep, but may be cylindrical or other convenient shape so long as the capacity of each is about five to eight cubic inches, since the amount of excess fuel that will activate the safety device is approximately three to five cubic inches. Balance arm 18 is of a size and shape that will fit into compartment 24 and provide support for receptacle 20 and float 140 and is preferably of rectangular shape, with its length being such that arm 18 does not touch either end of compartment or eductor tube 12.

Rod 30 may be cylindrical or another convenient shape that will move freely in a vertical manner inside guide 28, and is about three to five inches long. Rod guide 28 is long enough to reach from the top surface to the bottom surface of chamber 40, and is approximately one to two inches long. Port 26 is about one-fourth to one-half inch in diameter. Lever 38 is of a convenient shape, such as flat, so long as it is appropriate for connection to rod 30 and for actuation of wick extinguishing unit 42.

The sizes and weights of the components may be varied somewhat, so long as the net effect, including any spring tension or other mechanism, is to maintain receptacle 20 in its uppermost position, but such that amounts of liquid fuel on the order of several cubic inches will cause the receptacle to move downward.

OPERATION OF INVENTIVE ANTI-FLAREUP DEVICE—FIG. 2

During normal operation, valve 62 keeps the fuel level in chamber 40 at or below level A. Receptacle 20 normally stays in its most upward position, being held there by the marginally greater weight of float 14 acting through a pivot point 16.

If excess fuel is delivered to chamber 40, due to high vapor pressure fuel or any other cause, the excess fuel will flow through port 26 in rod guide 28 into receptacle 20. Receptacle 20 maintains its upward position until sufficient excess fuel overflows into it from chamber 40 through port 26 in rod guide 28.

When the weight of the excess fuel in receptacle 20 offsets the greater weight of float 14 and other components, receptacle 20 will move downward, pulling vertical Pod 30 down. When rod 30 and lever 38 move downward, the end of lever 38 opposite the attachment of rod 30 to lever 38 strikes and actuates wick extinguishing unit 42. The movement of operating lever 38 about pivot point 36 al so causes a deflection of warning gauge needle 34, which is attached to lever 38 at pivot point 36. The normal positioning of the components may be maintained by spring tension, or by other appropriate mechanisms.

If excess fuel continues to flow into receptacle 20, causing the fuel in receptacle 20 to overflow into the bottom of compartment 24, float 14 will rise, continuing the downward force on rod 30 through pivot point 16. This keeps warning gauge needle 34 deflected and wick extinguishing unit 42 actuated.

As long as the fuel that activated the device remains in compartment 24, the wick cannot be raised because the wick extinguishing unit will remain actuated. Also for this reason the warning gauge needle will continue to be deflected to indicate the presence of a dangerous condition in the burner. For the burner to be restored to normal operation, the fuel in compartment 24 must be removed. Fuel removal from compartment 24 can be accomplished by applying suction to the portion of eductor tube 12 outside compartment 24 after removal of cap 10.

Although automatic wick extinguishing unit 42 is illustrated as a wick drop mechanism, other devices are known for extinguishing the wick flame. For example, a horizontal barrier shutoff can alternatively be used. The present device can be utilized to activate other automatic wick extinguishing mechanisms by a suitable mechanism (not shown).

ADVANTAGES

It is clear from a consideration of the discussion above that the anti-flareup safety device is quite simple in construction and can be easily retrofitted to present wick-fed, barometric liquid fuel burners. Yet it will prevent flareup by providing an excess fuel containment system, and by quickly shutting off the wick flame before fuel can leak outside the containment systems and the leaked fuel can ignite.

In addition, the device includes a highly visible warning gauge needle to indicate danger from the presence of excess fuel in the fuel chamber, thereby alerting the user to the dangerous condition of the burner.

Also, the device provides a mechanism for easy resetting by the user if the device is triggered accidentally, so long as dangerous excess fuel conditions do not exist; in this way, any nuisance activation of the device is easily reversed.

The present device will shut down the liquid fuel burner prior to ignition and burning of fuel outside its intended site, that being at the wick, thereby saving fuel and reducing odor. Also, the device does not require any electrical power or electronic circuitry, being activated by the presence of excess fuel. Also, activation of the safety device mechanisms by the presence of excess fuel in the fuel chamber will prevent the wick from being raised and re-ignited, and the warning gauge needle will continue to be deflected to indicate the presence of a dangerous condition. Additionally, should excess fuel activate the safety device mechanisms, the excess fuel can be easily removed from the excess fuel containment compartment, so that the burner can be serviced and put back in operation without undue difficulty.

Clearly, the device incorporates multiple safety features, which will make wick-fed, barometric liquid fuel burners safer to operate, and accordingly, will at the same time reduce the expensive lawsuits resulting from flareup incidents causing injury, loss of life, and property damage. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings, specification and following claims.

For example, the shapes and composition of the various parts of the safety device can be varied greatly, so long as their function is preserved. Thus, while the rod and rod guide are depicted as being cylindrical, clearly they can have other shapes, such as oval, square, rectangular, etc. Also, the port for excess fuel flow from the fuel chamber into the excess fuel containment compartment does not necessarily have to be located in the rod guide, but may be located elsewhere in the bottom of the fuel chamber, and the port can be consist of several openings rather than just one as depicted.

In addition, the receptacle/float combination can be changed to just a float mechanism or just a receptacle mechanism for activation of the safety device. The excess fuel containment compartment is described as being square or rectangular when viewed from the top, but it may be oval, circular, etc. The dimensions of the excess fuel containment compartment are governed by the size of the space available under the fuel chamber. The warning gauge needle may be eliminated, as may be the eductor tube. Although the receptacle and float are described as being square or rectangular when viewed from above, they may have other shapes, such as circular, triangular. etc. While the preferred composition of the various parts of the safety device is metal, other materials may also be utilized, such as plastics, composites, etc.

Thus the scope of the invention should be determined, not by the examples given, but by the appended claims and their legal equivalents.

What is claimed is:

1. An apparatus for preventing flare-up in a liquid fuel burner of the type comprising a liquid fuel removable tank, a fuel chamber, and a combustion chamber having a wick, where said fuel chamber carries liquid fuel from said removable tank to said wick of said combustion chamber, comprising:

excess fuel containment means for receiving or holding fuel from said fuel chamber if the amount of fuel in said fuel chamber exceeds a predetermined level; and automatic flame extinguishing means for extinguishing the flame on said wick in response to said fuel in said fuel chamber exceeding said predetermined level.

2. An apparatus according to claim 1, wherein said excess fuel containment means comprises an excess fuel containment compartment and said automatic flame extinguisher means is responsive to the presence of fuel in said excess fuel containment compartment.

3. An apparatus according to claim 1, further including means for preventing re-ignition of any flame on said wick if said flame was extinguished due to the presence of said excess fuel in said fuel chamber.

4. An apparatus according to claim 1, wherein said excess fuel containment means comprises an excess fuel containment compartment and said automatic flame extinguisher means is responsive to the presence of fuel in said excess fuel containment compartment, and further including means for preventing re-ignition of any flame on said wick if said flame was extinguished due to the presence of said excess fuel in said fuel chamber.

5. An apparatus according to claim 1, further including means for providing a visual danger indication to alert the user of the dangerous condition of said excess fuel in an excess fuel containment compartment.

6. An apparatus according to claim 1, further including means for providing a visual danger indication to alert the user of the dangerous condition of said excess fuel in an excess fuel containment compartment, further including means for preventing re-ignition of any flame on said wick if said flame was extinguished due to the presence of said excess fuel in said fuel chamber.

7. An apparatus according to claim 1, further including means for directing the flow of said excess fuel into said excess fuel containment means, said directing means comprising a rod guide which connects said fuel chamber to said excess fuel containment compartment, said rod guide having a port therein.

8. An apparatus according to claim 1 wherein said excess fuel containment means comprises an excess fuel containment compartment, and further including means for directing said excess fuel in said fuel chamber into said excess fuel containment compartment, said excess fuel containment compartment containing a receptacle, said receptacle being arranged to move downward in response to said excess fuel, said receptacle being connected to a rod so that downward movement of said receptacle will pull said rod downward, said rod being connected to an operating lever, said operating lever being connected to said automatic flame extinguishing means.

9. An apparatus according to claim 1, wherein said excess fuel containment means comprises an excess fuel containment compartment, and further including means for removing said excess fuel from said excess fuel containment compartment, whereby said apparatus can be reset so that said wick can be re-ignited.

10. An apparatus according to claim 1, wherein said excess fuel containment means comprises an excess fuel containment compartment, and further including means for directing said excess fuel from said fuel chamber into said excess fuel containment compartment, said excess fuel containment compartment containing a float device situated on a balance arm, so that said excess fuel in said excess fuel containment compartment causes said float device to be urged upward, in turn causing a distal end from said float device of said balance arm to move downward, said balance arm being connected to a rod so that downward movement of said balance arm will pull said rod downward, said rod being connected an operating lever, said operating lever being connected to said automatic flame extinguishing means.

11. An apparatus for preventing flare-up in a liquid fuel burner of the type comprising a liquid fuel removable tank, a fuel chamber, and a combustion chamber having a wick, where said fuel chamber carries liquid fuel from said removable tank to said wick of said combustion chamber, comprising:

excess fuel containment means for receiving or holding fuel in which excess fuel is directed into an excess fuel containment compartment from said fuel chamber if the amount of fuel in said fuel chamber exceeds a predetermined level;

automatic flame extinguishing means for extinguishing a flame on said wick in response to said fuel in said fuel chamber exceeding said predetermined level;

means for preventing re-ignition of said wick if said flame was extinguished due to the presence of said excess fuel in said fuel chamber; and means for removing said excess fuel from said excess fuel containment means.

12. An apparatus according to claim 11, further including means for directing the flow of said excess fuel into said excess fuel containment means, said directing means comprising a rod guide which connects said fuel chamber to said excess fuel containment compartment, said rod guide having a port therein.

13. An apparatus according to claim 11, further including means for providing a visual danger indication to alert the user of the dangerous condition of said excess fuel in said excess fuel containment compartment.

14. An apparatus according to claim 11, further including means for directing the flow of said excess fuel into said excess fuel containment means, said directing means comprising a rod guide which connects said fuel chamber to said excess fuel containment compartment, said rod guide having a port therein.

15. An apparatus according to claim 11, further including means for providing a visual danger indication to alert the user of the dangerous condition of said excess fuel in said excess fuel containment compartment, and means for directing the flow of said excess fuel into said excess fuel containment means, said directing means comprising a rod guide which connects said fuel chamber to said excess fuel containment compartment, said rod guide having a port therein.

16. An apparatus according to claim 11, wherein said excess fuel containment means comprises and excess fuel containment compartment, and further including means for directing said excess fuel in said fuel chamber into said excess fuel containment compartment, said excess fuel containment compartment containing a receptacle, said receptacle being arranged to move downward in response to said excess fuel, said receptacle being connected to a rod so that downward movement of said receptacle will pull said rod downward, said rod being connected to an operating lever, said operating lever being connected to said automatic flame extinguishing means.

17. An apparatus according to claim 11, further including means for directing said excess fuel from said fuel chamber into said excess fuel containment compartment, said excess fuel containment compartment containing a float device situated on a balance arm, so that said excess fuel in said excess fuel containment compartment causes said float device to be urged upward, in turn causing a distal end from said float device of said balance arm to move downward, said balance arm being connected to a rod so that downward movement of said balance arm will pull said rod downward, said rod being connected to an operating lever, said operating lever being connected to said automatic flame extinguishing means.

18. A method of preventing flare-up in a liquid fuel burner of the type comprising a liquid fuel removable tank, a fuel chamber, and a combustion chamber having a wick, where said fuel chamber carries liquid fuel from said removable tank to said wick of said combustion chamber, comprising the steps of:

absorbing excess fuel in said fuel chamber by directing fuel wherein exceeds a predetermined level in said fuel chamber into an excess fuel containment compartment;

directing the flow of said excess fuel in said excess fuel containment compartment into a receptacle in said excess fuel containment compartment; and extinguishing the flame on said wick in response to said flow of said excess fuel into said receptacle.

19. The method of claim 18 wherein said flame is extinguished by causing said receptacle to move downward in response to the weight of said excess fuel.

20. The method of claim 19 wherein said flame is extinguished on said wick in response to downward movement of said receptacle.

* * * * *